US006869301B2

(12) United States Patent
Shimizu et al.

(10) Patent No.: US 6,869,301 B2
(45) Date of Patent: Mar. 22, 2005

(54) ELECTRICAL CONNECTOR

(75) Inventors: Shinji Shimizu, Tokyo (JP); Masahiro Tanaka, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/805,258

(22) Filed: Mar. 22, 2004

(65) Prior Publication Data

US 2004/0192100 A1 Sep. 30, 2004

(30) Foreign Application Priority Data

Mar. 24, 2003 (JP) ..... 2003-079816

(51) Int. Cl.[7] ..... H01R 13/62
(52) U.S. Cl. ..... 439/324; 439/362; 439/349
(58) Field of Search ..... 439/324, 347, 439/348, 349, 351, 352, 362, 8

(56) References Cited

U.S. PATENT DOCUMENTS 5,791,932 A * 8/1998 Hasenfratz ..... 439/347
5,836,781 A * 11/1998 Hyzin ..... 439/348

FOREIGN PATENT DOCUMENTS

| | | | |
|---|---|---|---|
| DE | 3735164 C1 * 11/1988 | ..... | 439/347 |
| JP | 6-163109 * 6/1994 | ..... | 439/347 |
| JP | 11-16634 1/1999 | | |

* cited by examiner

*Primary Examiner*—Tho D. Ta
(74) *Attorney, Agent, or Firm*—Takeuchi & Takeuchi

(57) ABSTRACT

An electrical connector (11) comprises an insulating housing (13), a plurality of contact elements (10) provided in a widthwise direction of the insulating housing, at least one guide portion 917) provided at a position where no contact element is present and guiding the connector to a position for plugging with a mating electrical connector (12), and a lock portion (18) provided at a top of the guide portion. The lock portion has a shape of a substantially sphere or a shape of a polyhedron having a top view of a substantially circle and locks a plugging condition between the electrical connectors.

9 Claims, 7 Drawing Sheets

ELECTRICAL CONNECTOR

BACKGROUND OF THE INVENTION

1. Field of the Invention

The present invention relates to an electrical connector, especially an electrical connector having a plurality of contact elements provided in a widthwise direction.

2. Description of the Related Art

Some electrical connectors applicable for a portable telephone are provided with a plurality of contact elements provided in a widthwise direction and capable of locking and unlocking the plugging with a mating connector only by inserting and removing the connector into and from the mating connector in a plugging direction. Since they do not need a button and so forth, they are called a simple lock type. This type of connector is mostly used for application requiring frequent plugging and removing operations. In order to perform smooth plugging operation, as shown in FIG. 12, guide projections 3 are provided on sides of contact elements of a connector 1 and a cavity 5 is provided in a metal case 4 of a mating connector 2 to receive the guide projection 3. For maintaining the plugging of the connectors 1 and 2 in a stable condition and keeping the contact between the contact elements of the connectors 1 and 2 in a good condition, a locking piece 6 made of a metal spring made by press is provided in the guide projection 3 and an engagement hole 7 made by press is provided in the metal case 4 to engage the locking piece 6.

When plugging the connector 1 into the mating connector 2, both the guide projections 3 are inserted into the cavity 6. The locking piece 6 is resiliently deformed (in downward direction in FIG. 12) to engage the engagement hole 7 so that the plugging condition between the connectors 1 and 2 is locked and the contact elements of the connectors 1 and 2 are brought into contact with each other.

When unplugging the connector 1 from the mating connector 2, the connector 1 is pulled (in a right direction in FIG. 12). The locking piece 6 is resiliently deformed again so that the engagement between the locking piece 6 and the engagement hole 7 is released and the plugging condition between the connectors 1 and 2 is also released.

Japanese Patent Application Kokai Number 11-16634 discloses a similar simple lock type connector.

However, in such a conventional connector, since the engagement between the locking piece 6 and the engagement hole 7 is performed only on one side, if the connector 1 is inserted into the mating connector 2 in an inclined condition, even if it is a small inclination in any direction, it is difficult to secure a good plugging between the connectors 1 and 2. Also, if forcibly inserted or removed, the connectors 1 and 2 may be broken, resulting in a malfunction.

Also, since the locking piece 6 and the engagement hole 7 are made by press, the fractures 8 and 9 of the locking piece 6 and the metal case 4 are brought into contact to each other every time the connector 1 and 2 plugged or unplugged. Consequently, the locking piece 6 and the metal case 4 are scraped away by friction of the contact, which gradually reduces the maintaining strength of the lock. Also, it is possible that shavings produced by the friction between the locking piece 6 and the metal case 7 are adhered to the contact element, which makes worse the contact condition between the connectors 1 and 2.

Moreover, since the locking piece 6 projects outwardly, it may be hooked on clothes during the plugging and unplugging operation of the connectors, which reduces the working efficiency.

SUMMARY OF THE INVENTION

Accordingly, it is an object of the invention to provide an electrical connector, wherein the connector is not broken even when forcibly inserted or removed in any direction, thus securing firm operation, the friction wear of the metal upon the insertion and removal of the connector is controlled, thus preventing the reduction of the maintaining strength of the lock, and increasing the working efficiency of the plugging and unplugging operation.

According to an aspect of the invention, an electrical connector comprises an insulating housing, a plurality of contact elements provided in a widthwise direction of the insulating housing, at least one guide portion provided at a position where no contact element is present and guiding the connector to a position for plugging with a mating electrical connector, and a lock portion provided at a top of the guide portion, having a shape of a substantially sphere or a shape of a polyhedron having a top view of a substantially circle, and locking a plugging condition between the electrical connectors.

The lock portion may have a cut-off so that the lock portion is resiliently deformed in a radial direction thereof.

It is preferable that the lock portion is made of a metal.

It is preferable that the lock portion is made by press.

It is preferable that the lock portion has an asymmetric shape.

According to another aspect of the invention, an electrical connector comprises an insulating housing, a plurality of contact elements provided in a widthwise direction of the insulating housing, at least one lock receiving portion provided at a position where no contact element is present and having an engagement section having a curved surface or made resiliently deformed to be engageable with a lock portion of a mating connector, which is provided at a top of the mating connector and has a shape of a substantially sphere or a shape of a polyhedron having a top view of a substantially a circle.

It is preferable that the lock receiving portion is made of a wire of resilient material.

The lock receiving portion may be made a C-shaped ring spring.

The lock receiving portion may be made of two wires of a resilient material and provided in parallel to each other.

Fixed portions may be provided such that it extend rearwardly from ends of the lock receiving portion to fix the lock receiving portion to the lock portion of the mating connector.

The lock receiving portion may be made of a plate of a resilient material.

An asymmetric though-hole may be provided in a metal shell of the electrical connector to receive the lock portion.

According to still another aspect of the invention, an electrical connector assembly comprises a first electrical connector and a second electrical connector, said first electrical connector including a first insulating housing, a plurality of first contact elements provided in a widthwise direction of the first insulating housing, at least one guide portion provided at a position where no first contact element is present and guiding the first connector to a position for plugging with the second connector, and a lock portion provided at a top of the guide portion and having a shape of a substantially sphere or a shape of a polyhedron having a top view of a substantially circle, and the second electrical connector including a second insulating housing, a plurality of second contact elements provided in a widthwise direction of the second insulating housing, at least one lock receiving portion provided at a position where no second contact element is present and having an engagement section having a curved surface or made resiliently deformed to be engageable with the lock portion of the first electrical connector, wherein a plugging between the first and second electrical connectors is locked by engagement between the lock portion and the lock receiving portion.

With such structures, is provided an electrical connector, wherein even when forcible insertion or removal in any directions is attempted, the connectors are not broken, the firm operation is secured, the frictional wear of the connector members during the plugging and unplugging is controlled, the reduction of the maintaining strength of the lock is prevented, and the working efficiency of the plugging and unplugging operation is prevented.

DESCRIPTION OF THE PREFERRED EMBODIMENTS

Embodiments of the present invention will now be described with reference to the accompanying drawings.

A connector 11 and a mating connector 12 are electrically connected to each other when the connector 11 is plugged into the mating connector 12.

Figure 1:
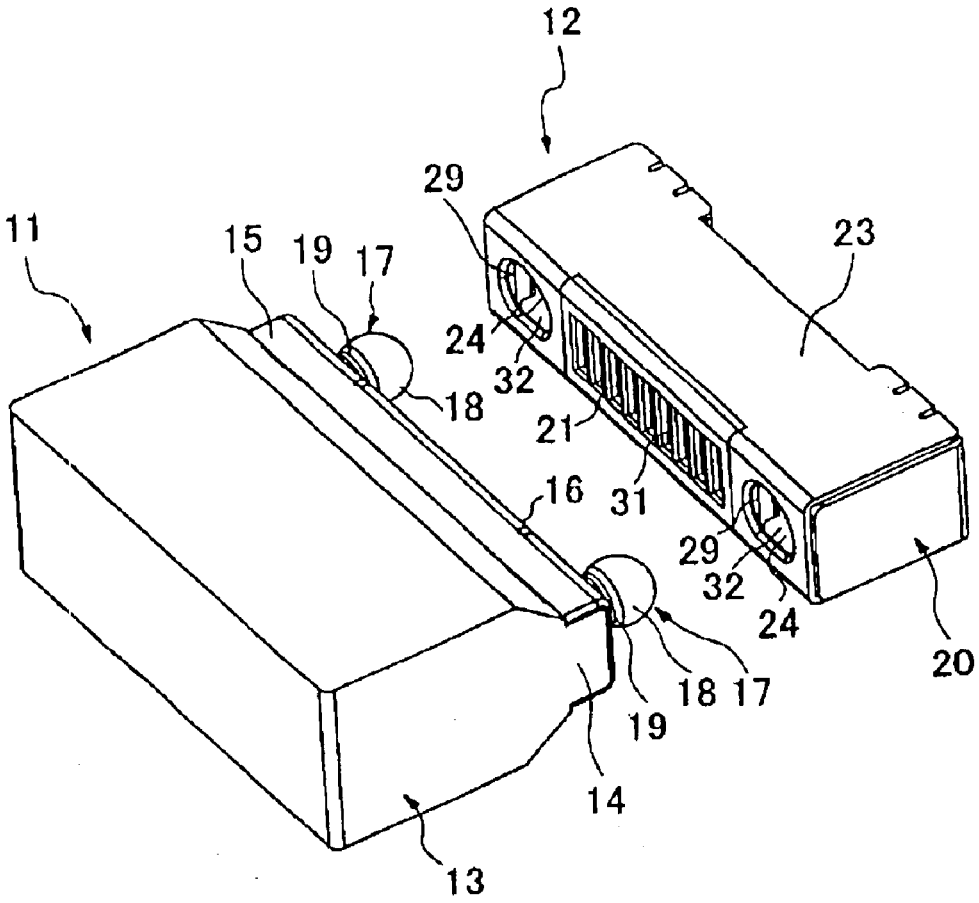
FIG. 1 is a perspective view of an electrical connector according to an embodiment of the present invention.
Figure 2:
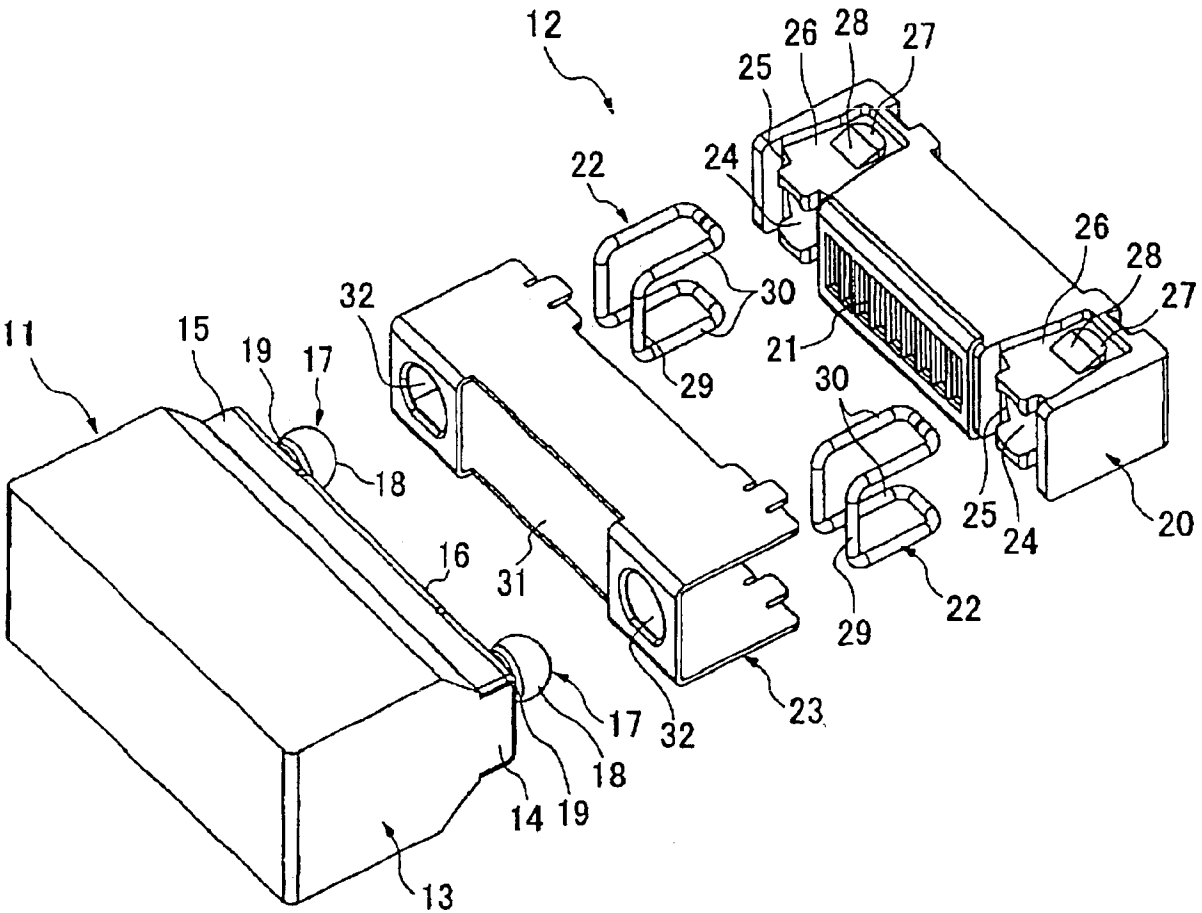
FIG. 2 is a exploded perspective view of the electrical connector FIG. 1.
Figure 3:
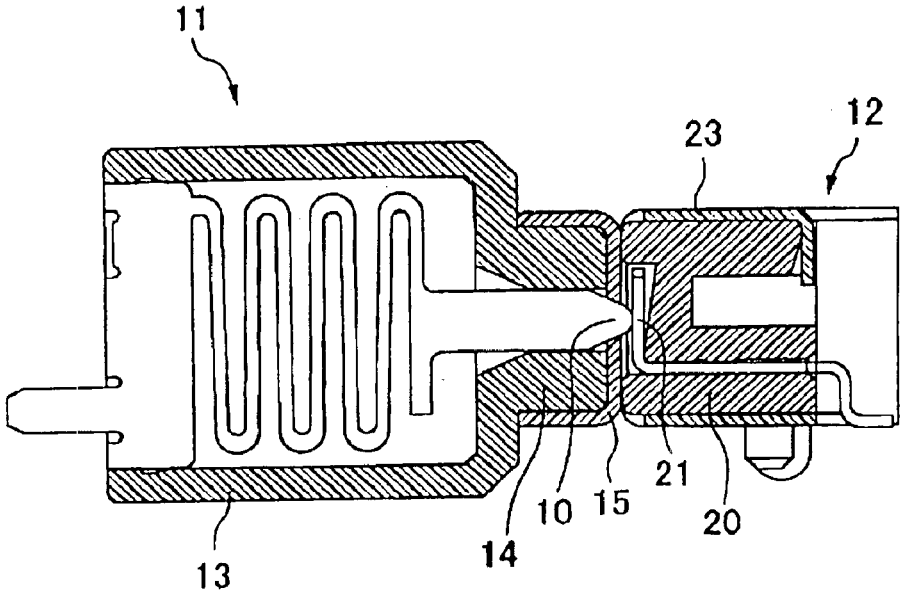
FIG. 3 is a sectional view of the electrical connector of FIG. 1.

In FIGS. 1–3, the connector 11 comprises an insulating housing 13 of a substantially rectangular parallelepiped which is long in a widthwise direction thereof, a plurality of contact elements 10 provided in a front end 14 of the insulating housing 13 in the widthwise direction of the housing 13, and a metal shell 15 covering the front end 14 of the insulating housing 13. The metal shell 15 is provided with a plugging face 16 for the contact elements 10 at a front face thereof. A pair of guide portions 17 projecting in a plugging direction of the connector 11 are provided at sides of the plugging face 16. Here, the guide portions 17 are provided at positions where no contact element is present, however, not always provided at sides of the contact elements 10. A lock portion 18 is provided at the top end of each of the guide portions 17. The lock portion 18 has a shape of substantially sphere or a shape of polyhedron having a top view of a substantially circle. An engagement dent 19 is provided at the base of the lock portion 18. Here, the shape of the lock portion 18 is not limited to a shape of a complete sphere but includes shapes of a substantially sphere, a cone, a mushroom, or a polyhedron having a top view of a substantially circle. Also, the shape is not always required to be a closed curved plane but may have a hole anywhere in the curved plane. Moreover, as described later, the shape may be asymmetry for the purpose of preventing a plugging error. The method of forming the lock portion 18 is not limited to one but it is desirable for cost saving that it is made by press molding.

The mating connector 12 comprises an insulating housing 20 of a substantially rectangular parallelepiped which is long in a widthwise direction thereof, a plurality of contact elements 21 arranged on the front end of the insulating housing 20 in the widthwise direction of the housing 20 at positions corresponding to those of the contact elements 10 of the connector 11, a wire-like engagement members 22 fixed to the insulating housing 20 at sides of the contact elements 21, and a metal shell 23 covering the insulating housing 20.

A pair of cavities 24 are provided on the front end of the insulating housing 20 at positions where no contact element 21 is present. Narrow grooves 25 extending in an up-and-down direction are provided at sides of the respective cavities 24. Shallow grooves 26 are provided in the insulating housing 20 on upper and lower sides of the respective cavities 24. An engagement projection 27 is provided in each of the respective shallow grooves 26 and a sloped surface 28 is formed on the front side of the engagement projection 27.

Figure 4:
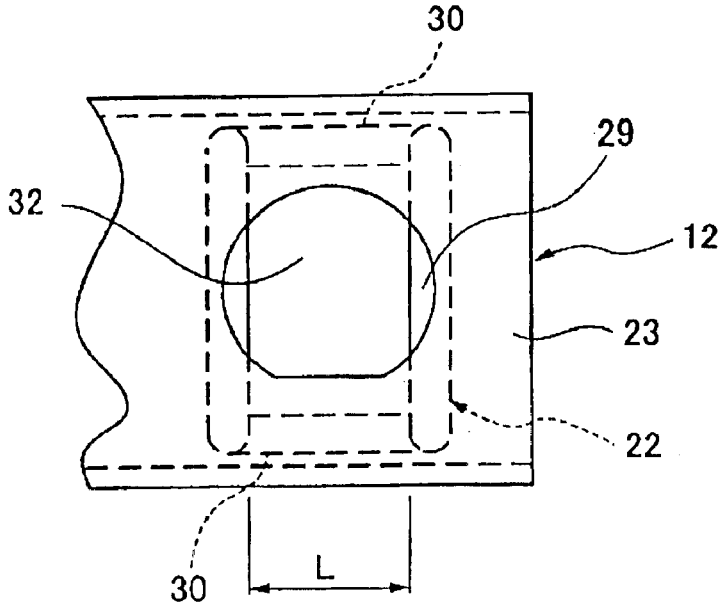
FIG. 4 is a side view of a lock receiving portion of the electrical connector according to the embodiment of the present invention.

The engagement member 22 is composed of lock receiving portions 29, which are two resilient members extending in an up-and-down direction in parallel to each other, and fixed portions 30, which extend rearwardly from upper and lower ends of the lock receiving portions 29 having a shape of "U". Each of the respective resilient members of the lock receiving portions 29 has a sectional shape of a circle and a distance L between the two lock receiving portions 29 is made smaller than an external diameter of the lock portion 18 (FIG. 4). When the fixed portions 30 of the engagement member 22 are inserted into the shallow grooves 26 from the front of the insulating housing 20, the fixed portions 30 engage the engagement projections 27 and the lock receiving portions 29 are plugged into the narrow grooves 25, thus the engagement member 22 is fixed to the insulating housing 20. Since the sloped surface 28 is provided on the front side of the engagement projection 27, the engagement member 22 is fixed to the insulating housing 20 smoothly.

The metal shell 23 is bent in a form of substantially "C" and has an opening 31 on front side thereof so that the contact elements 21 are exposed from the opening 31. The metal shell 23 also has a pair of through-holes 32 having a shape of a circle at sides of the opening 31, into which the lock portions 18 are plugged. When the metal shell 23 covers the insulating housing 20, as shown in FIG. 4, parts of the lock receiving portions 29 are exposed from sides of the through-hole 32. The lock receiving portions 29 are provided at positions where no contact element 21 is present but not always limited to the sides of the contact elements 21.

The through-hole 32 is made asymmetric by cutting off part of the circle for the purpose of preventing a plugging error. By do this, even when the connector 11 is attempted to be inserted into the mating connector 12 up side down by mistake, the shapes of the lock portion 18 and the through-hole 32 are not agreeable, thus preventing a plugging error. The asymmetric shape is not limited to the shape described above but any shape suitable for the prevention of plugging error may be acceptable.

The operation of the connector according to the present invention will now be described with reference to FIGS. 1–3.

Figure 5:
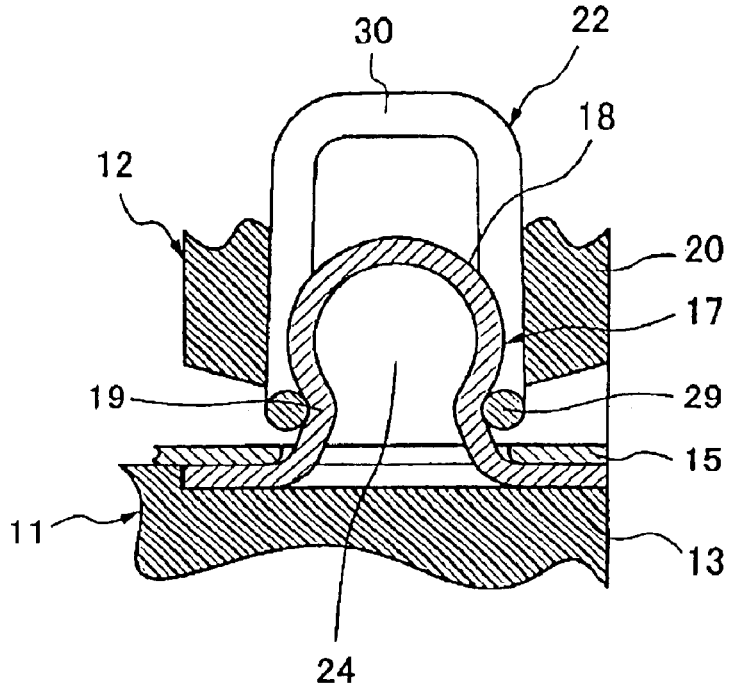
FIG. 5 is a sectional view of the electrical connector of FIG. 4 showing a plugging condition.

When inserting the connector 11 into the mating connector 12, the lock portions 18 of the respective guide portions 17 are positioned to the through-holes 32 to guide the connector 11 to the plugging position with the mating connector 12. As the connector 11 is pushed into the mating connector 12, the lock receiving portions 29 are pushed outwardly to the right and left sides by the lock portions 18. When the connector 11 is further pushed, the lock portions 18 pass the lock receiving portions 29 and are plugged into the cavities 24. The lock receiving portions 29 return to the original position and engage the engagement dents 19 after the lock portions 18 passed the lock receiving portion 29 (FIG. 5). Since the paralleled wire-like resilient members of the engagement members 22 prevent the lock portions 18 from being off to the right and left sides, the plugging condition of the connector 11 into the connector 12 is locked and the contact condition between the contact elements 10 and 21 of the connectors 11 and 12 is also secured firmly. This embodiment is ideal when a plurality of spring terminals are arranged in the right and left direction (direction perpendicular to the sheet of the drawing) as shown in FIG. 3 because the movement of the connectors to the right and left sides is prevented.

When removing the connector 11 from the mating connector 12, the connector 11 is pulled in the reverse of the plugging direction. The lock receiving portions 29 are pushed outwardly to the right and left sides by the lock portions 18 and return to the original positions after the lock portions 18 passed the lock receiving portions 29. Consequently, the lock receiving portions 29 and the engagement dents 19 are disengaged, and the plugging condition between the connectors 11 and 12 is released.

Figure 6:
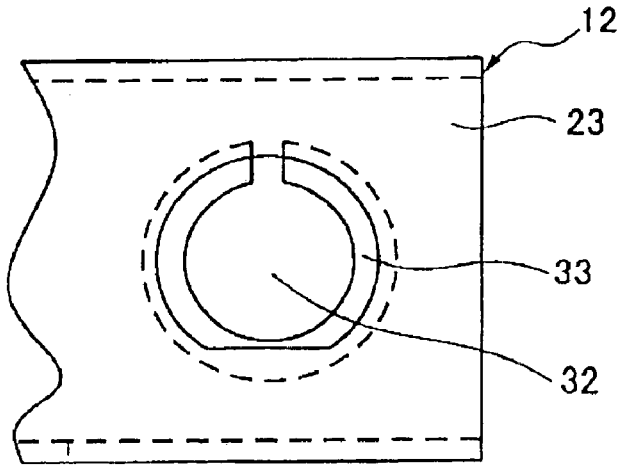
FIG. 6 is a side view of a lock receiving portion of the electrical connector according to another embodiment of the present invention.
Figure 7:
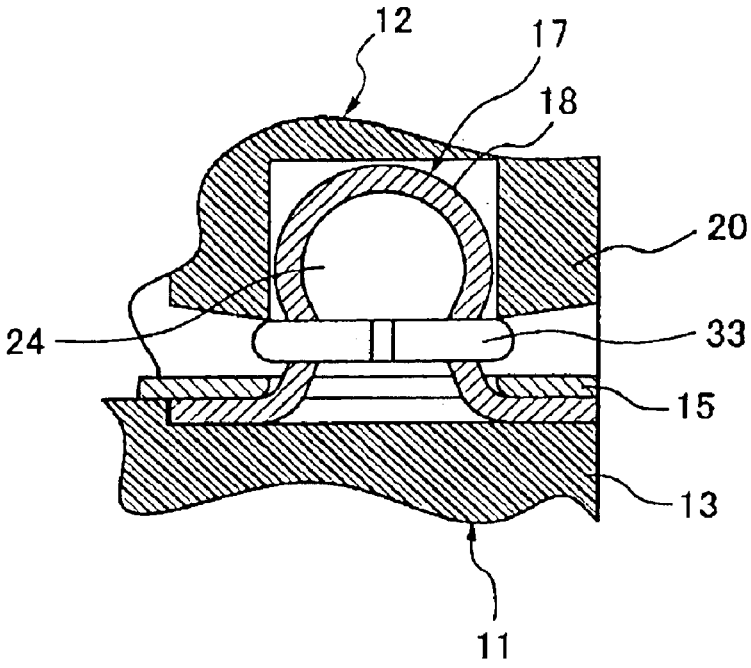
FIG. 7 is a side view of the electrical connector of FIG. 6 showing a plugging condition.

The engagement member 22 of the mating connector 12 is not limited to the above-described structure. In FIGS. 6 and 7, a wire is formed to the C-shaped spring ring to be used as a lock receiving portion 33. In this case, when the connector 11 is inserted into or removed from the mating connector 12, the lock receiving portion 33 is resiliently deformed in a radial direction thereof. It is more preferable if the wire for the C-shaped ring has a sectional shape of a circle.

Figure 8:
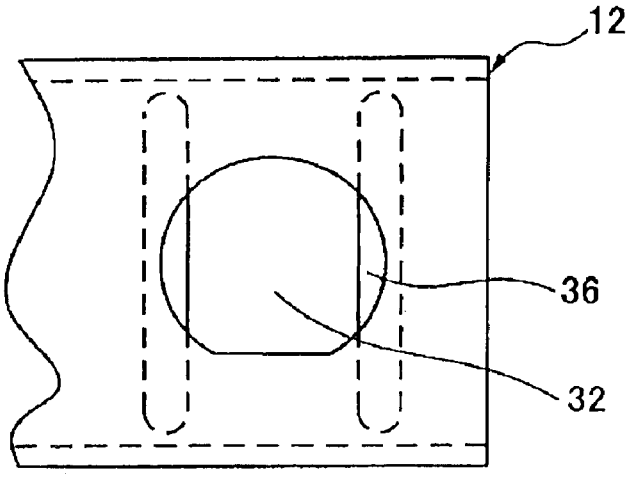
FIG. 8 is a side view of a lock portion and a lock receiving portion of the electrical connector according to still another embodiment of the present invention.
Figure 9:
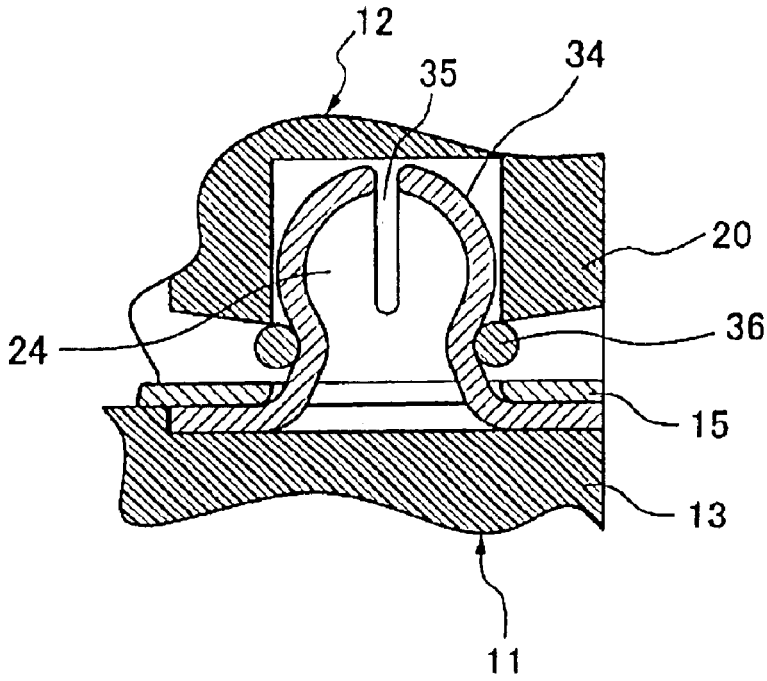
FIG. 9 is a sectional view of the electrical connector of FIG. 8 showing a plugging condition.

In FIGS. 8 and 9, a lock portion 34 of the connector 11 is provided with a cut-off 35 extending in an up-and-down direction. A lock receiving portion 36 is fixed such that it is not resiliently deformed in the right and left direction. In this case, the lock portion 34 is resiliently deformed in the right and left direction when the connector 11 is inserted into or removed from the mating connector 12.

Figure 10:
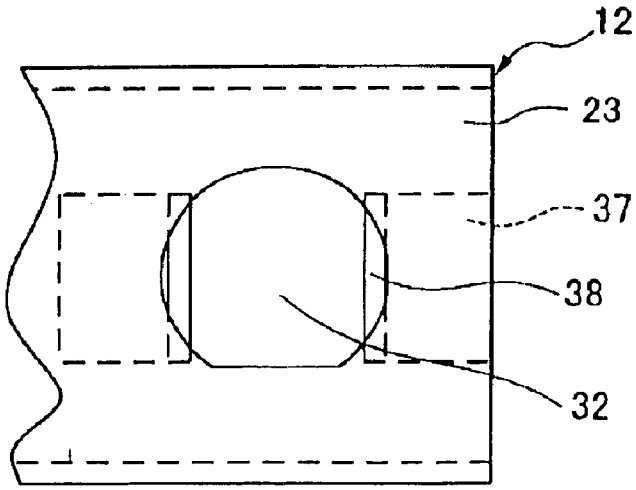
FIG. 10 is a side view of a lock receiving portion of the electrical connector according to yet another embodiment of the present invention.
Figure 11:
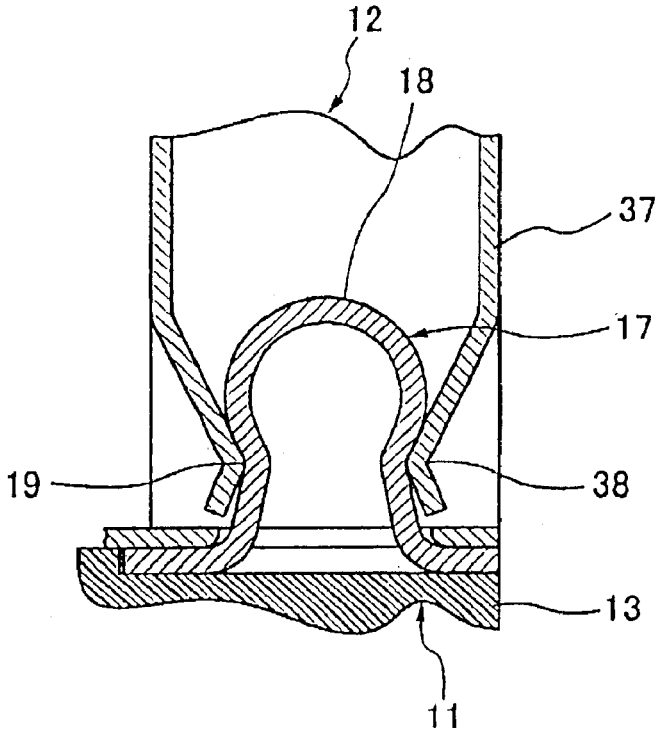
FIG. 11 is a side view of the electrical connector of FIG. 10 showing a plugging condition.
Figure 12:
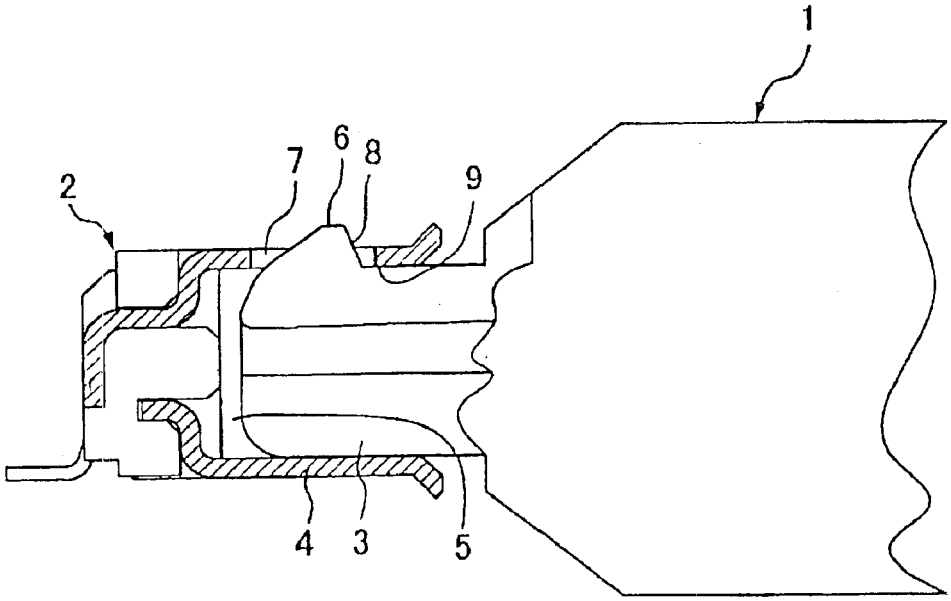
FIG. 12 Prior Art
FIG. 12 is a partly sectional view of part of a conventional electrical connector showing a plugging condition.

In FIGS. 10 and 11, a pair of plate springs 37 having curved portions 38 at the top thereof are provided instead of the engagement member 22. In this case, the curved surfaces of the curved portions 38 hold the engagement dent 19 of the lock portion 18 therebetween to lock the plugging of the connector 11 into the mating connector 12.

As fully described above, the lock portion has a shape of a substantially sphere or a shape of a polyhedron having a top view of a substantially circle so that even if the connector is inclined with respect to the mating connector in any direction or is forcibly inserted into or removed from the mating connector, the plugging and unplugging are easily performed without damaging the connectors and the firm operation is secured.

Also, a part of the connectors, such as the edge of the fracture, is not scraped or worn away by the contact during the plugging or unplugging, thus preventing the reduction of the maintaining strength of the lock and increasing the durability of the connectors. There is no danger that shavings produced by the contact of the lock portions is adhered to the contact elements, thus causing no adverse influence on the contact condition between the contact elements.

Moreover, since the lock portions are not hooked on clothes and so forth, the working efficiency of plugging and unplugging operation increases.

In addition, the guide portion has both functions of guiding the plugging between the connectors and locking the plugging condition between the connectors so that it is possible to simplify the structure, reduce the number of parts, and reduce the manufacturing cost.

What is claimed is:

1. An electrical connector comprising:

an insulating housing;

a plurality of contact elements provided in a widthwise direction of said insulating housing;

at least one guide portion provided at a position where no said contact element is present and guiding said connector to a position for plugging with a mating electrical connector; and a lock portion provided at a top of said guide portion, having a shape of a substantially sphere or a shape of a polyhedron having a top view of a substantially circle, and locking a plugging condition of said electrical connector into said mating electrical connector, wherein said lock portion is made of a metal by press.

2. The electrical connector according to claim 1, wherein said lock portion has a cut-off for enabling said lock portion to be resiliently deformed in a radial direction thereof.

3. The electrical connector according to claim 1, wherein said lock portion has an asymmetric shape.

4. An electrical connector comprising:

an insulating housing;

a plurality of contact elements provided in a widthwise direction of said insulating housing;

at least one lock receiving portion provided at a position where no said contact element is present and made engageable with a lock portion of a mating electrical connector, which is provided at a top of said mating electrical connector and has a shape of a substantially sphere or a shape of a polyhedron having a top view of a substantially circle, wherein said lock receiving portion has an engagement section having a curved surface or made resiliently deformed to engage said lock portion, wherein said lock receiving portion is made of a wire of a resilient material.

5. The electrical connector according to claim 4, wherein said lock receiving portion is made of two wires of a resilient material provided in parallel to each other.

6. The electrical connector according to claim 4, wherein said lock receiving portion is made of a plate of a resilient material.

7. The electrical connector according to claim 4, which further comprises a metal shell having at least one through-hole for receiving said lock portion, wherein said through-hole has an asymmetric shape.

8. The electrical connector according to claim 4, wherein said wire of said lock receiving portion is made a C-shaped ring spring.

9. The electrical connector according to claim 8, which further comprises fixed portions extending rearwardly from ends of said lock receiving portion to fix said lock receiving portion to said lock portion of said mating electrical connector.

* * * * *